US005077894A

United States Patent [19]

Martin et al.

[11] Patent Number: 5,077,894

[45] Date of Patent: Jan. 7, 1992

[54] METHOD OF MAKING A SHELL WITH AN INTEGRAL PASSAGE

[75] Inventors: Jacob H. Martin, Wellesley; Charles S. Elder, Bedford, both of Mass.

[73] Assignee: The Charles Stark Draper Laboratory, Cambridge, Mass.

[21] Appl. No.: 524,503

[22] Filed: May 17, 1990

Related U.S. Application Data

[62] Division of Ser. No. 357,883, May 30, 1989.

[51] Int. Cl.[5] ..... B21D 53/04

[52] U.S. Cl. ..... 29/890.039; 29/890.07; 29/463; 165/170; 126/377

[58] Field of Search ..... 29/890.039, 890.041, 29/890.042, 890.07, 463; 165/169, 170; 126/377

[56] References Cited

U.S. PATENT DOCUMENTS

| | | | |
|---|---|---|---|
| 3,757,855 | 9/1973 | Kun et al. | 29/890.039 |
| 4,598,450 | 7/1986 | Thompson et al. | 29/890.039 |
| 4,687,053 | 8/1987 | Paulus et al. | 29/840.039 |
| 4,700,445 | 10/1987 | Raskin | 29/890.039 |
| 4,896,247 | 1/1990 | Cozer | 165/169 |

FOREIGN PATENT DOCUMENTS

| | | | |
|---|---|---|---|
| 258273 | 9/1931 | Italy . | |
| 22540 | of 1913 | United Kingdom | 257/211 |
| 886873 | 1/1962 | United Kingdom | 29/890.039 |
| 1371797 | 11/1974 | United Kingdom | 165/169 |

*Primary Examiner*—Irene Cuda
*Attorney, Agent, or Firm*—Iandiorio & Dingman

[57] ABSTRACT

A method of making a formed non-planar heat exchanger is disclosed in which two non-planar plates are continuously joined across their contacting surfaces and are complementarily curved to form an integral curved member where at least one of the contacting surfaces is provided with at least one channel to define an integral internal heat exchange fluid flow passage within and conforming to the curved contour of the curved member.

9 Claims, 6 Drawing Sheets

METHOD OF MAKING A SHELL WITH AN INTEGRAL PASSAGE

This is a division of application Ser. No. 07/357,883, filed May 30, 1989.

FIELD OF INVENTION

This invention relates to a method and apparatus relating to a shell formed with one or more internal passageways, and more particularly to such a device adapted for use in a heat exchanger.

BACKGROUND OF INVENTION

Inertial guidance systems of all types, e.g. gimballed, laser, floating stable member, require a heat exchange system for removing heat from the internal volume of the housing in a controlled manner. Presently many heat exchange systems use separate tubes or channels which are brazed, soldered, glued or otherwise attached to the housing. Those tubes or channels conduct the coolant which carries the heat away from the internal inertial guidance system. The attachment of separate tubes is extremely labor intensive and expensive, and highly skilled personnel are required. In some cases the labor requirement and expense are further increased by the milling in the housing of grooves or gutters in which the tubes will nest, in order to improve surface-to-surface contact for heat conduction. Further, heat transfer into the separate tubes is not efficient or uniform. In addition, the separate externally mounted tubes are highly susceptible to damage during fabrication and throughout the life of the equipment. The need to solder the lengths of tubes to each other and to a manifold introduces the potential for leaks and the potential for blockages caused by excess solder creeping into the joints Solder operations also leave flux residues that must be cleaned out. If the metals involved are not naturally solderable they must first be plated to enable soldering.

SUMMARY OF INVENTION

It is therefore an object of this invention to provide an improved method for forming an internal passage in a curved member.

It is a further object of this invention to provide such an improved method which requires less skilled personnel, less labor, and is less expensive to perform.

It is a further object of this invention to provide such an improved method which eliminates the use of soldering techniques to install a passage a heat exchanger and avoids the problem of solder blockages and flux residue in the passage.

This invention results from the realization that a more reliable, rugged, simpler, and more efficient heat exchanger could be achieved by making the normally external, separate heat exchanger fluid flow passages internal and integral, and the further realization that a heat exchanger shell or any shell could be fabricated with an integral internal passage by creating a groove in one or both of two plates, bonding the plates together to form a closed passage with the groove, and then converting or forming the plates into the desired shape such as a shell or dome or hemisphere by forming, drawing, bending, or the like.

This invention features a formed shell having an integral internal passage. The shell includes two non-planar plates which are continuously joined across their contacting surfaces and which are complementarily curved to form an integral curved shell. At least one channel is formed in at least one of the plates to define an integral internal fluid flow passage with the curved contours of the shell.

In preferred embodiments the passage may extend transverse to the forming direction or axis. The forming may include drawing, the plates may be brazed together, the shell may be domed or hemispherical. In one construction the shell forms a part of a heat exchanger which employs fluid flowing through the passage as the heat exchanging medium.

The invention also features a method of fabricating a shell having an integral internal passage. Two plates of malleable material are provided and a groove is created in at least one of those plates. The plates are then bonded together to create a closed internal passage from the groove. The bonded plates are then formed into a shell shape. The groove may be created extending generally transverse to the forming axis, the material may be aluminum, the bonding technique may be brazing, and the forming technique may include drawing, bending, or hydroforming.

In one technique the groove is filled before the forming step with a filler having a lower melting point than brazing material and the material of which the plates are made, and then after the forming step the shell is heated to extract the filler. When used as a heat exchanger, a manifold is mounted on the member or shell for accessing the internal integral passage.

DISCLOSURE OF PREFERRED EMBODIMENT

Other objects, features and advantages will occur to those skilled in the art from the following description of a preferred embodiment and the accompanying drawings, in which.

Figure 6:
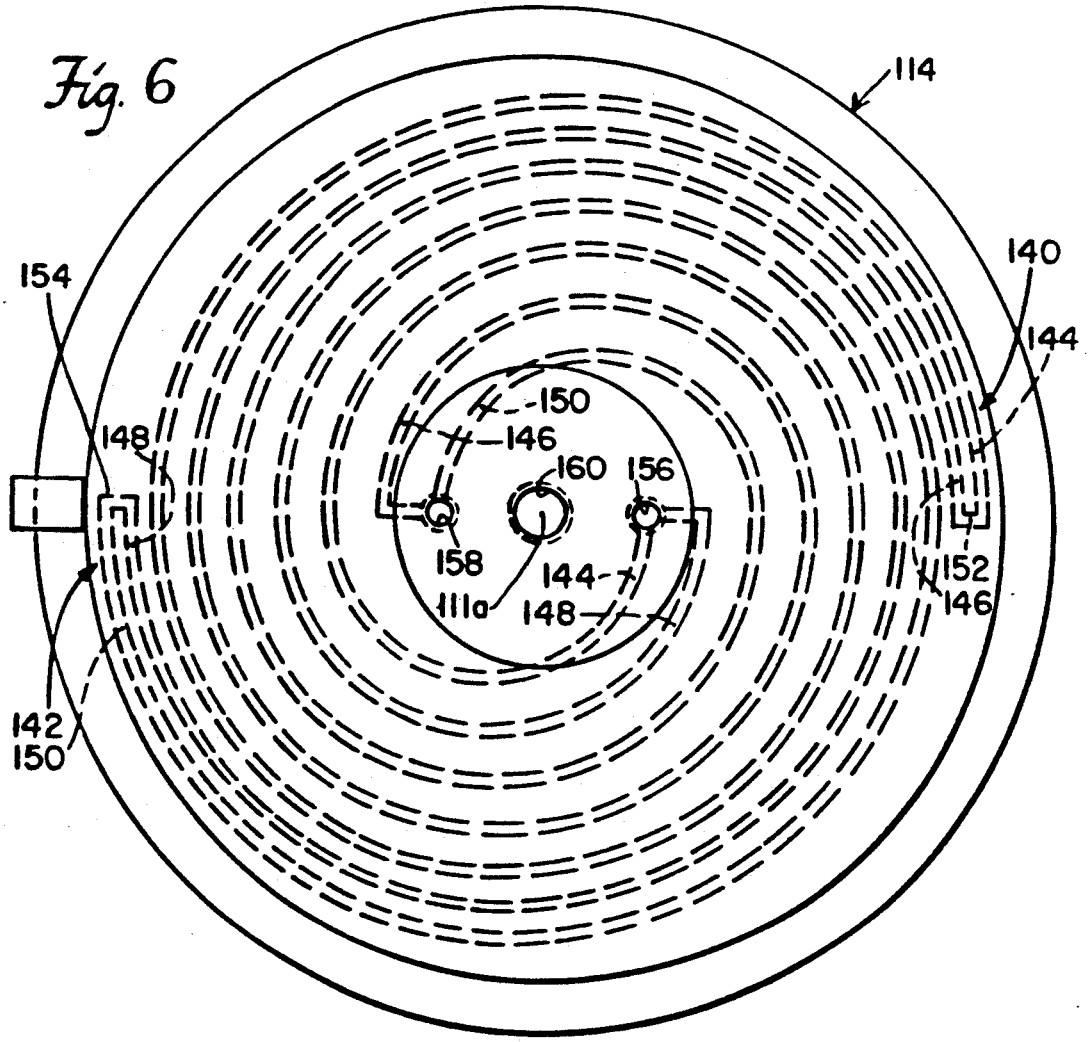
Figure 4:
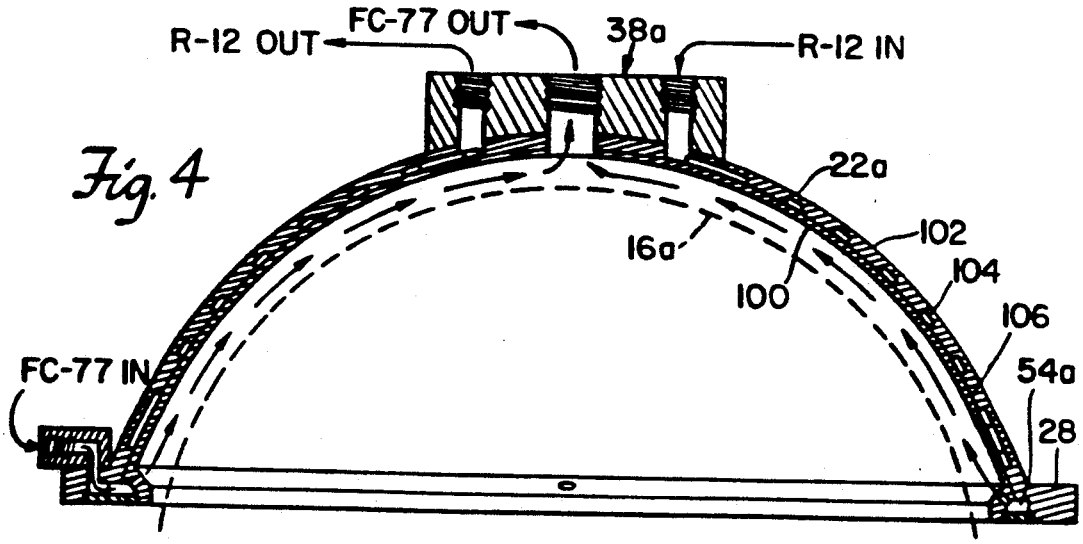
FIG. 4 is a schematic elevational sectional view of a shell with an internal integral passage made according to this invention for use in an inertial guidance device such as shown in FIGS. 1-3.

FIGS. 5A-D depict four steps in forming the shell of FIG. 4 according to this invention;

FIG. 6 is a top plan view of the shell of FIG. 4; and

Figure 7:
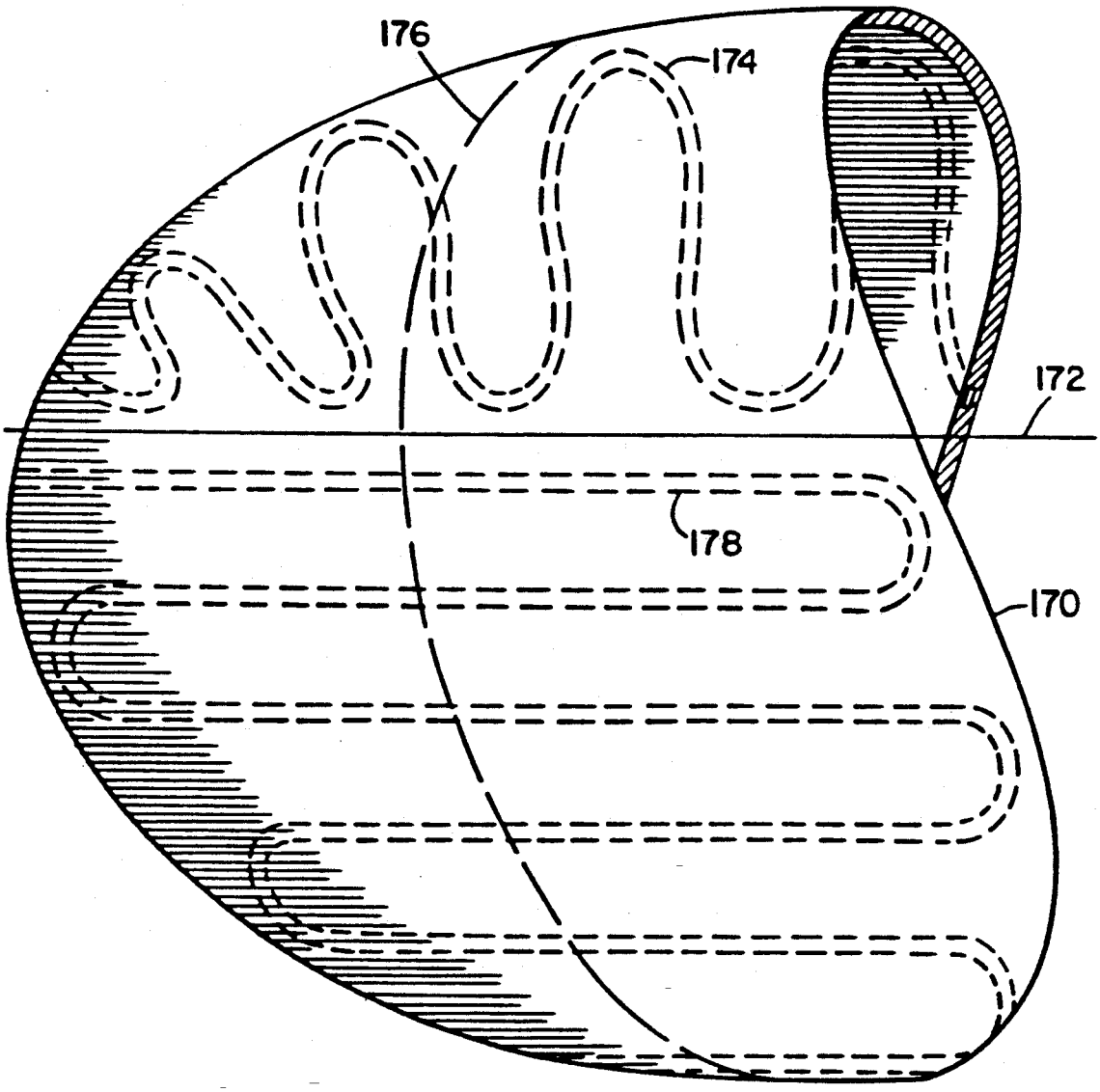

FIG. 7 is a diagrammatic view of an axisymmetric shell made according to this invention having alternatively oriented passages in it.

Figure 1:
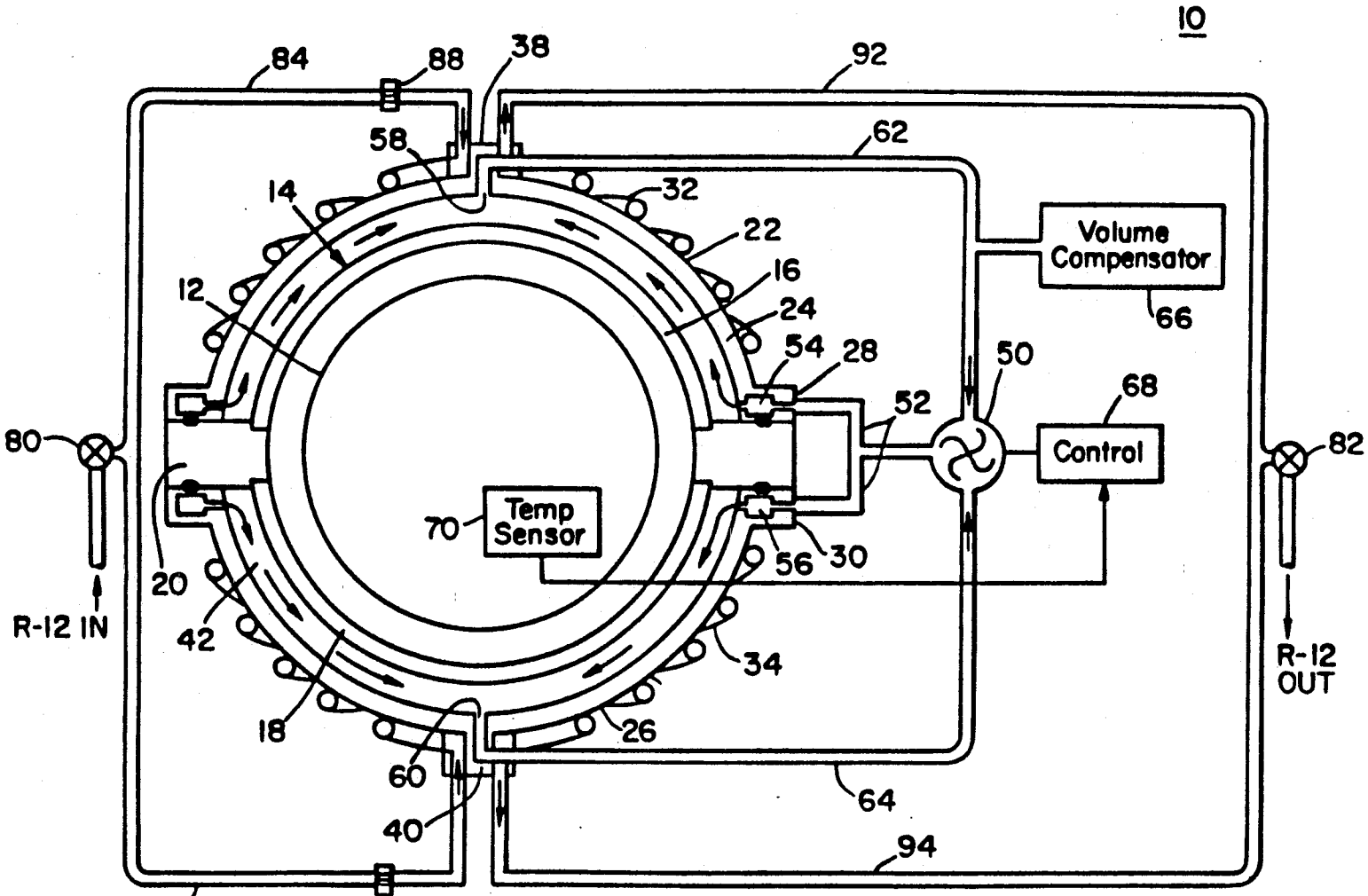
Fig. 1 PRIOR ART
FIG. 1 is a simplified schematic sectional elevational view of a prior art inertial guidance device showing the heat exchanger equipment.

There is shown in FIG. 1 a prior art inertial guidance device 10 which includes the stable member 12 hydraulically suspended inside power sphere 14. Power sphere 14 includes an upper, positive hemisphere 16 and a lower, negative hemisphere 18 which are joined together and electrically insulated from one another by equatorial ring 20. Surrounding power sphere 14 is heat transfer housing 22 which includes an upper section 24 and lower section 26. Sections 24 and 26 each include flanges 28 and 30, respectively, by which they are secured to equatorial ring 20. Fixed to the outside of sections 24 and 26 is piping 32 and 34. These pipes are fastened to the outside of sections 24 and 26 by gluing, soldering, brazing, or similar means. In some cases grooves are milled into the sections at added expense in order to improve the seating and heat transfer to tubes 32 and 34. manifold caps 38 and 40 serve to introduce and exhaust cooling fluid to tubes 32 and 34, and exhaust flotation fluid from the internal spherical annular volume 42 between power sphere 14 and heat exchanger sections 24 and 26. Volume 42 functions as a variable resistance heat path. Flotation fluid such as FC-77 is driven from pump 50 through conduits 52 into annular passages 54 and 56. From these passages which circle the device in flanges 28 and 30, the FC-77 flows out into volume 42 toward end caps 38 and 40, where it is exhausted at ports 58 and 60 through conduits 62 and 64 back to pump 50. A volume compensator 66 keeps the FC-77 at a relatively constant pressure, and a control circuit 68 drives the pump 50 to pump more or less fluid as a function of the temperature of the inertial guidance system as sensed by temperature sensor 70. The primary heat exchange system employs tubes 32 and 34. Cooling fluid such as refrigerant R-12 is supplied by a source, not shown, through valve 80 and is recovered through valve 82. Incoming R-12 is provided through conduits 84 and 86, provided with expansion devices 88 and 90 to the inputs of tubes 32 and 34, respectively, at manifolds 38 and 40. The R-12 flows through the tubes toward the equatorial ring and then back up again to the manifold caps 38 and 40, where the R-12 is exhausted through conduits 92 and 94 to heat exchanger pressure control valve 82.

Figure 2:
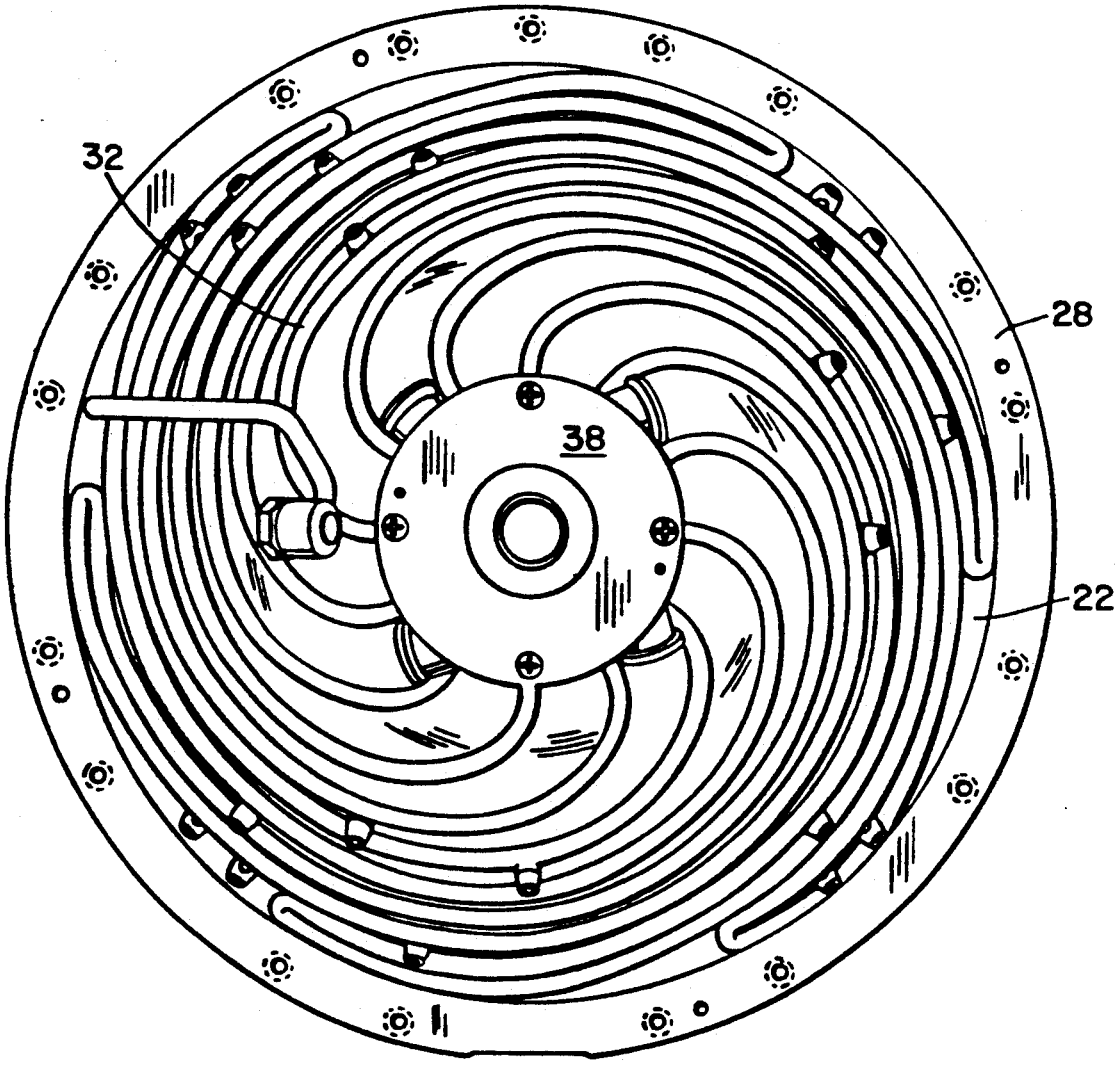
Fig 2 PRIOR ART
FIG. 2 is a top plan view of the prior art device of FIG. 1 showing the heat exchanger tubes.
Figure 3:
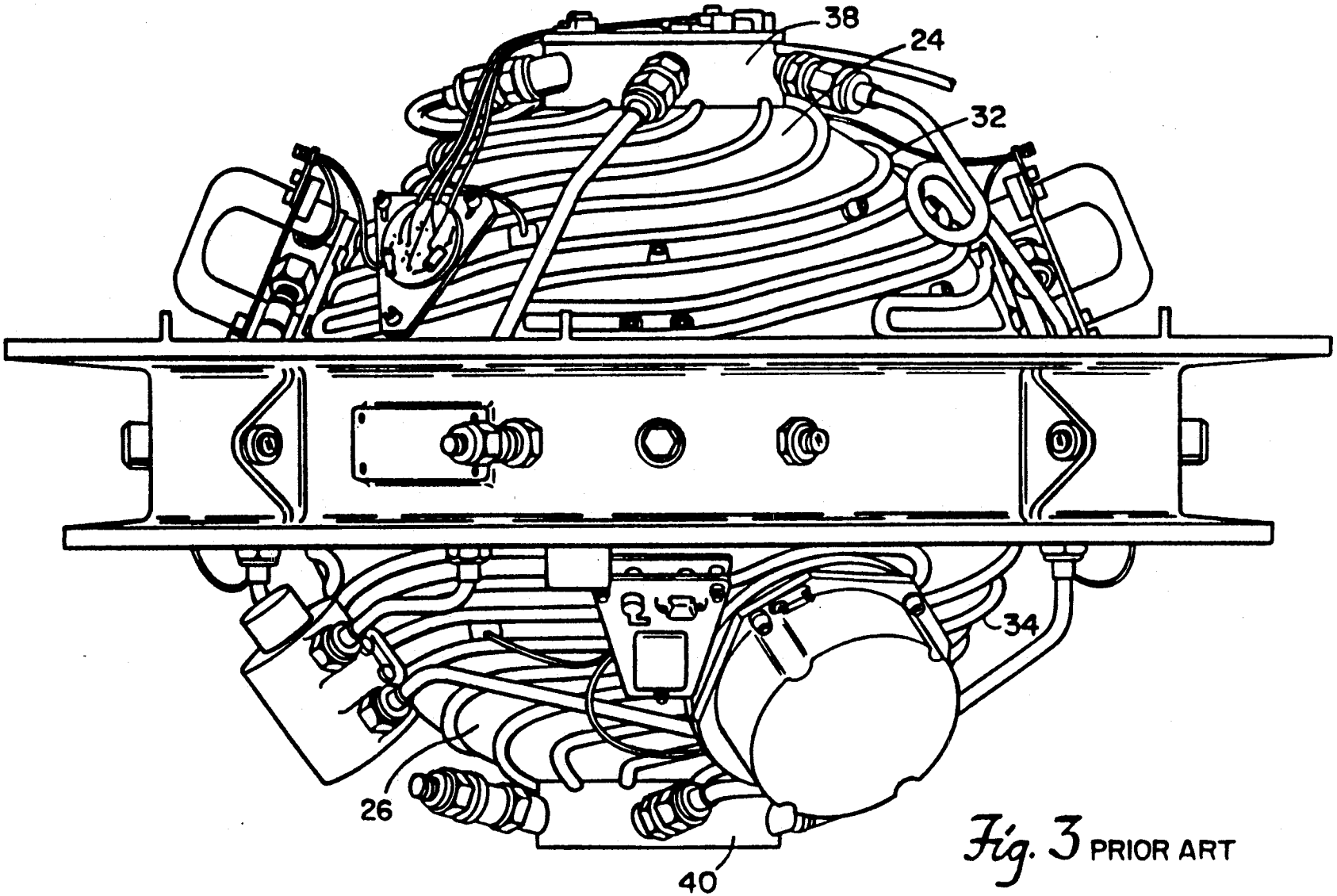
Fig. 3 PRIOR ART
FIG. 3 is a side elevational view of a completed prior art inertial measurement unit sphere also showing the external cooling tubes.

The complexity of the prior art heat exchanger using tubes 32 and 34 can be seen more readily in FIG. 2, which shows a more detailed view of inertial guidance device 10 looking down from the top on the upper hemisphere 22. An even more vivid portrayal of the complexity of the prior art is shown in FIG. 3, which is a side elevational view of the inertial guidance device 10 with a mounting ring obscuring the equatorial ring.

In accordance with this invention, the heat exchanger housing is formed with an integral internal fluid flow passage for receiving the heat exchanging fluid such as shown in FIG. 4, where housing section **22*a* has been formed with two curved members 100, 102, that form internal integral passage 104 in housing section 22*a*. The passage 104 is shown in curved plate 102 but may as well be in curved plate 100, or in both. The line 106 shows where the two plates 100 and 102 were previously joined before being formed into the curved housing section 22*a***.

Figure 5B:
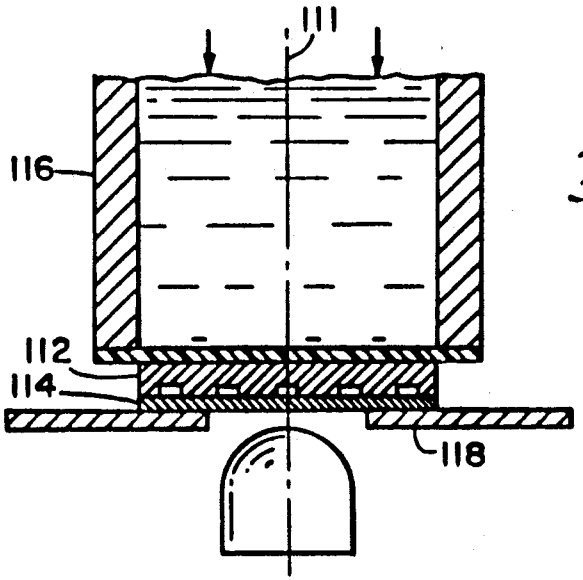
Figure 5D:
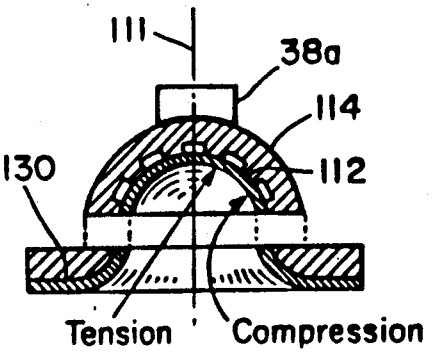
Figure 5A:
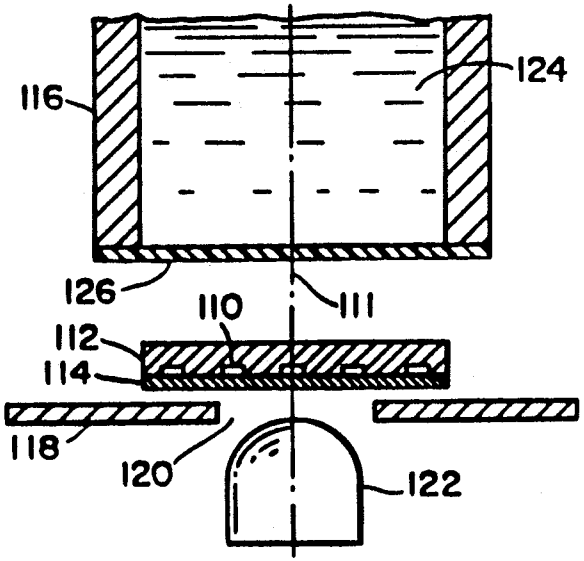

The heat exchanger section **22*a* is made according to the method of this invention as shown in FIGS. 5A–D. First a groove or a plurality of grooves 110, FIG. 5A, are formed in plate 112, which is then bonded such as by brazing to a second plate 114. The plates may be joined continuously over their contacting surface or discretely but sufficiently to produce sealed passages derived from the grooves. The plates or blank are made of a malleable material such as annealed aluminum. Typically plate 114 is thinner than plate 112, and so it is placed away from the hydraulic cylinder 116 to prevent it from being collapsed into grooves 110 during the forming process. The plates are then positioned on table 118, which contains a hole 120 for receiving steel punch 122. Hydraulic cylinder 116 is filled with hydraulic fluid 124 under pressure from a source not shown, and the bottom of cylinder 116 is sealed by a rubber diaphragm 126. At this time, or previously, the grooves may be filled with a material which has a lower melting temperature than plates 112 and 114** and the brazing or joining material. These techniques prevent distortion of the grooves during the forming process. After the process is complete, the shell may be heated to flow the filler material, which may be for example Cerrobend.

Figure 5C:
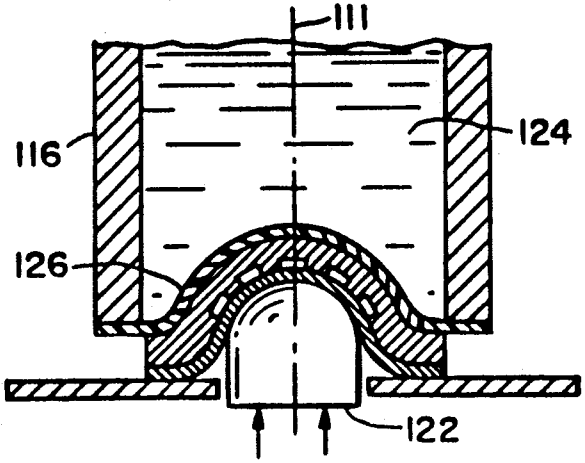

Next, hydraulic cylinder 116 is lowered to contact the top of plate 112 and pressure is applied, FIG. 5B. Following this, as shown in FIG. 5C, steel punch 122 is driven upwardly along the longitudinal draw axis 111 and plates 112 and 114 are formed about steel punch 122 against the pressure on diaphragm 126. The pressure of hydraulic fluid 124 is maintained, but fluid is allowed to escape as punch 122 rises. Finally, in FIG. 5D, the pressure of hydraulic cylinder 116 is released and the cylinder is raised. The blank is removed and the formed plates 114 and 112 then have the lower portion 130 trimmed off to produce the final piece such as **22*a*, FIG. 4. Manifold cap 38*a* is then fastened to plate 114**.

In one construction plate 114 is five-eighths inch thick and seventeen inches in diameter, provided with channels 0.156 inch wide and 0.110 inch deep; plate 112 is approximately one-eighth inch thick. Such a plate may begin as a square and end as shown in FIG. 6, with two sets of grooves 140 and 142, each including a pair of grooves 144, 146 and 148, 150, which extend parallel to each other, respectively, in a spiral directed inwardly toward the center. Grooves 144 and 146 are joined at junction 152 and grooves 148 and 150 are connected at junction 154. Thus fluid introduced from a manifold cap through hole 156, spirals down through groove 148, across junction 154 to groove 150, and then up through hole 158 to the manifold cap. Likewise, fluid introduced through hole 156 to groove 144 enters groove 146 through junction 152 and exits through hole 158. The center hole 160 provides access to the internal heat exchange volume 42 as originally discussed in FIG. 1.

In the fabrication described in FIGS. 4 and 5A–5D, it is preferable to maintain the grooves generally transverse to the direction of forming for least groove deformation. Since the direction of forming is along the draw axis or longitudinal axis **111*a*, FIG. 6**, then the groove should be maintained as much as possible parallel to the corresponding latitude lines.

Although thus far the shells formed have been shown as symmetrical about a forming axis, this is not a necessary limitation of the invention, for as shown in FIG. 7, the shell 170 can be asymmetrical. Similarly, although the grooves in FIGS. 4 through 6 are shown as generally transverse to the forming axis, this is also not a limitation of the invention, for as shown in FIG. 7 the grooves forming the passage 174 could meander generally in the direction of the longitudinal axis or forming axis 172 while locally meandering back and forth more parallel to the latitude lines symbolized at 176 Alternatively, passage 178 could meander generally in the direction of latitude line 176 while locally meandering generally parallel to the direction of the longitudinal axis or forming axis 172.

Although specific features of the invention are shown in some drawings and not others, this is for convenience only as each feature may be combined with any or all of the other features in accordance with the invention.

Other embodiments will occur to those skilled in the art and are with the following claims:

What is claimed is:

1. A method of fabricating a shell having an integral internal fluid flow passage comprising:

providing first and second plates of malleable material;

creating a groove in the surface of the first said plate;

bonding together said grooved surface of the first plate to a surface of said second plate to create a closed internal passage; and forming the bonded plates into a shell shape.

2. The method of claim 1 in which said groove extends generally transverse to an axis of the formed shell.

3. The method of claim 1 in which said material is aluminum.

4. The method of claim 1 in which said bonding includes brazing.

5. The method of claim 1 in which said forming includes drawing.

6. The method of claim 1 in which said forming includes bending.

7. The method of claim 1 in which said forming includes hydroforming.

8. The method of claim 1 further including filling the groove before said forming step with a filler having a lower melting point than said malleable material and any bonding material, and heating said shell after said forming step to extract said filler.

9. The method of claim 1 further including mounting a manifold on said shell for accessing said passage.

* * * * *